United States Patent [19]

Overmyer

[11] 4,086,847

[45] May 2, 1978

[54] MULTI-POSITION DUCT SYSTEM

[75] Inventor: Robert C. Overmyer, Indianapolis, Ind.

[73] Assignee: Hawley Manufacturing Corporation, Indianapolis, Ind.

[21] Appl. No.: 745,795

[22] Filed: Nov. 29, 1976

[51] Int. Cl.[2] ..... F23J 11/00

[52] U.S. Cl. ..... 98/115 VM; 104/52; 137/580

[58] Field of Search ..... 98/115 VM, 115 R; 202/263; 137/580; 51/99; 104/52

[56] References Cited

U.S. PATENT DOCUMENTS

| | | | |
|---|---|---|---|
| 1,464,297 | 4/1923 | Schodder | 98/115 R |
| 3,380,371 | 4/1968 | Scheel | 98/115 VM |

FOREIGN PATENT DOCUMENTS

| | | | |
|---|---|---|---|
| 214,440 | 4/1941 | Switzerland | 98/115 R |

*Primary Examiner*—Ronald C. Capossela
*Attorney, Agent, or Firm*—Jenkins, Coffey & Hyland

[57] ABSTRACT

A multi-position duct system includes a generally horizontally extending first duct section having one wall defined by a flexible web. The first duct section has first and second ends and is pivotally mounted adjacent its first end for movement in a horizontal arc about a support member. A car is mounted on the first duct section for longitudinal movement. The car engages the flexible web to define within the car a chamber in open communication with the interior of the first duct section. A second telescoping duct section having vertically upper and lower ends is attached at its upper end to the car and moves therewith longitudinally of the first duct section. The second duct section also is in open communication with the chamber. A hood for collecting air containing pollutant fumes and particles is attached to the lower end of the second duct section. The first duct section is attached to a source of suction. The hood can be positioned at a selected vertical height a selected distance from the support member to withdraw pollutant-laden air from a work area.

14 Claims, 5 Drawing Figures

MULTI-POSITION DUCT SYSTEM

This invention relates to exhaust systems for removing waste-laden air from a work space. More particularly, this invention relates to a flexible multi-position duct system for attachment to a stationary suction source, the duct system inlet being movable to a number of positions in a work space surrounding the suction source. The waste-laden air may be air containing suspended particulate contaminants or harmful or deleterious fumes generated during operations performed in the work space.

Various types of apparatus for movably supporting an exhaust hood in a work area are well known. See, for example, U.S. Pat. No. 3,698,137 issued Oct. 17, 1972. Such apparatus usually includes articulated conduit means coupled between a suction or partial vacuum source and the exhaust hood for capturing harmful and/or deleterious wastes suspended in the air about the work station and for conveying such wastes away from the work station.

It is an object of the present invention to provide an improved multi-position support system for such an exhaust hood. The inventive exhaust system includes generally horizontally extending conduit means having proximal and distal ends and means for flexibly, i.e., movably, supporting the conduit means adjacent the proximal end thereof. In the illustrated embodiments, the horizontally extending conduit means is pivotally supported upon the support means to provide freedom in the placement of an exhaust hood connected by other conduit means to the horizontally extending conduit.

According to the present invention, a multi-position support system for an exhaust hood includes a generally horizontally extending first conduit coupled to a source providing a partial vacuum. The first conduit has first and second ends. Means are provided for supporting the first conduit, the conduit being attached to the support means adjacent its first end in the manner of a jib boom. A generally vertically extending second conduit is provided for supporting the exhaust hood, the second conduit having a first vertically upper end and a second vertically lower end. Means are provided for coupling the upper end to the first conduit for movement axially along the first conduit. Additional means are provided for coupling the second end to the exhaust hood.

In the illustrated embodiments, the second conduit includes means for adjusting the vertical distance between the first conduit and the exhaust hood. Such adjustment means includes a telescoping joint intermediate the first and second ends of the second conduit and counterweight means coupled to the vertically lower telescoping section of the second conduit to ease adjustment of the distance between the hood and the first conduit.

Further according to the invention, a first conduit comprises an elongated duct having first and second ends and at least one wall closed by a flexible web. The conduit includes a car mounted for movement along the duct. The car and web cooperate to define within the car a chamber communicating with the interior of the elongated duct. The first conduit is flexibly supported adjacent its first end by support means, the first conduit being movable with respect to the support means.

Further, in the illustrated embodiments, the support means includes floor-mounted means forming with the first conduit a jib support structure for the second conduit and hood. Suspension cable means may be provided further to strengthen the support for the second end of the first, generally horizontal conduit. Such cable means may be connected between the vertically extending support means and the distal end of the generally horizontal conduit.

The invention may best be understood by referring to the following description and accompanying drawings which illustrate the invention. In the drawings.

Figure 2:
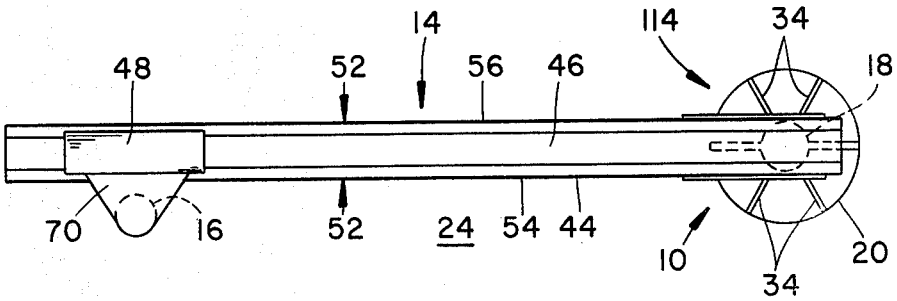
FIG. 2 is a top plan view of the system of FIG. 1.
Figure 1:
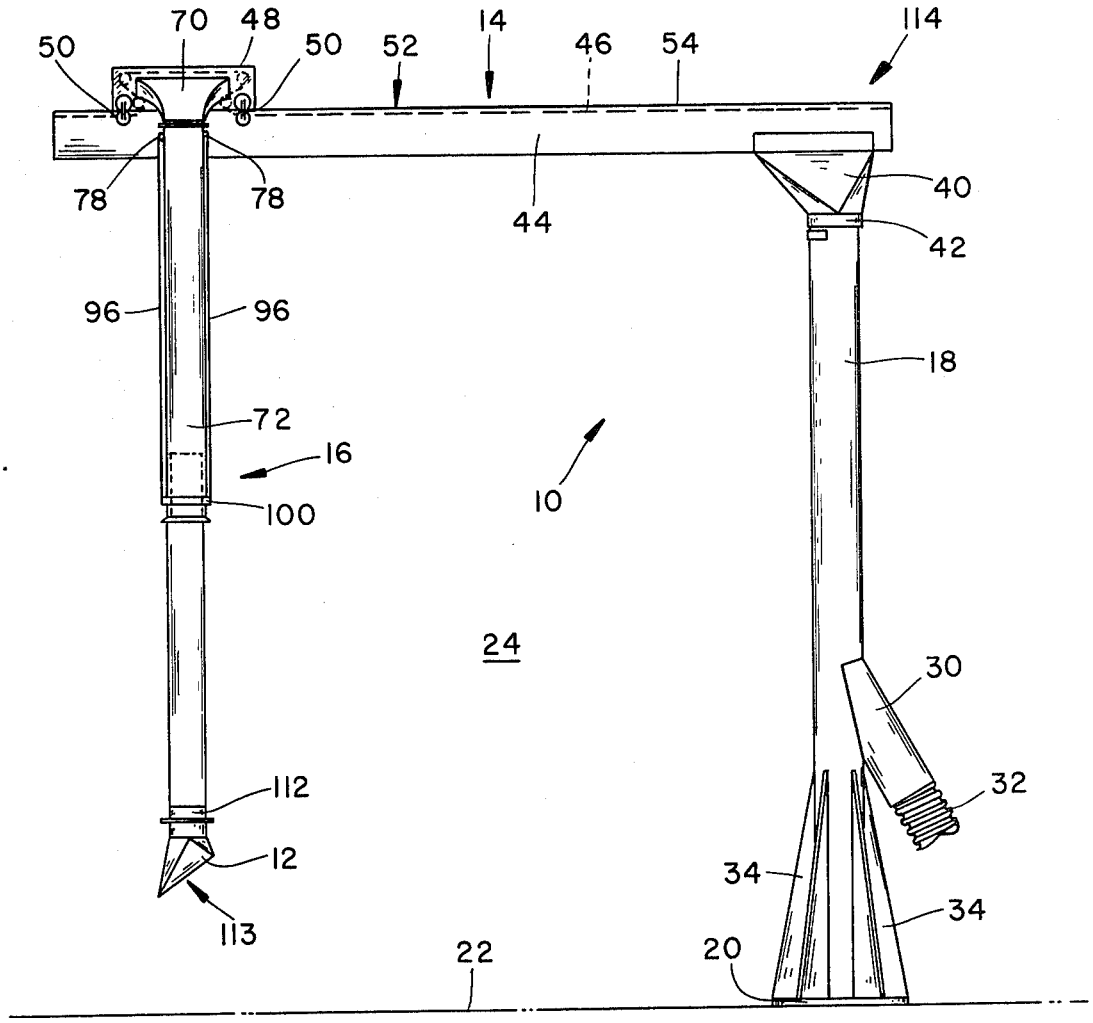
FIG. 1 is a side elevational view of a multi-position exhaust hood support system constructed in accordance with the present invention.

Referring now to the drawings, and particularly to FIGS. 1–2, a support system 10 for an exhaust hood 12 includes a generally horizontally extending first conduit 14 and a generally vertically extending second conduit 16. System 10 further includes a vertically extending support column 18 having a base 20 which is mounted upon the floor 22 of a work area 24.

Column 18 has a hollow interior which communicates through a duct section 30 and a flexible duct section 32 to a suction source, e.g., a fan (not shown). Duct section 30 is joined to column 18 adjacent the vertically upper ends of a plurality of braces 34 which are jointed to base 20 and extend therefrom vertically and radially of the column 18 axis.

Column 18 is joined to the horizontal conduit 14 by a circular-to-rectangular cross-section adapter 40 and a flexible, i.e., swivel, joint 42, both of which are designed to support the jib boom configuration of conduit 14 on column 18. Conduit 14 includes a main portion 44 having a generally rectangular cross section. Adapter 40 and swivel joint 42 provide communication between the interior of supporting column 18 and main portion 44. The upper side wall 46 of main portion 44 comprises a flexible web of material. Conduit 14 further includes a car 48 mounted for movement on rollers 50 along a pair of tracks 52 which extend longitudinally of main portion 44 adjacent the upper edges 54, 56 thereof. The material of upper side wall 46 cooperates with car 48 in a well-known manner described in, for example, U.S. Pat. Nos. 2,923,227 issued Feb. 2, 1960, and 3,478,668 issued Nov. 18, 1969, to provide a chamber within car 48 which is in open communication with the interior of main portion 44 of conduit 14.

Figure 5:
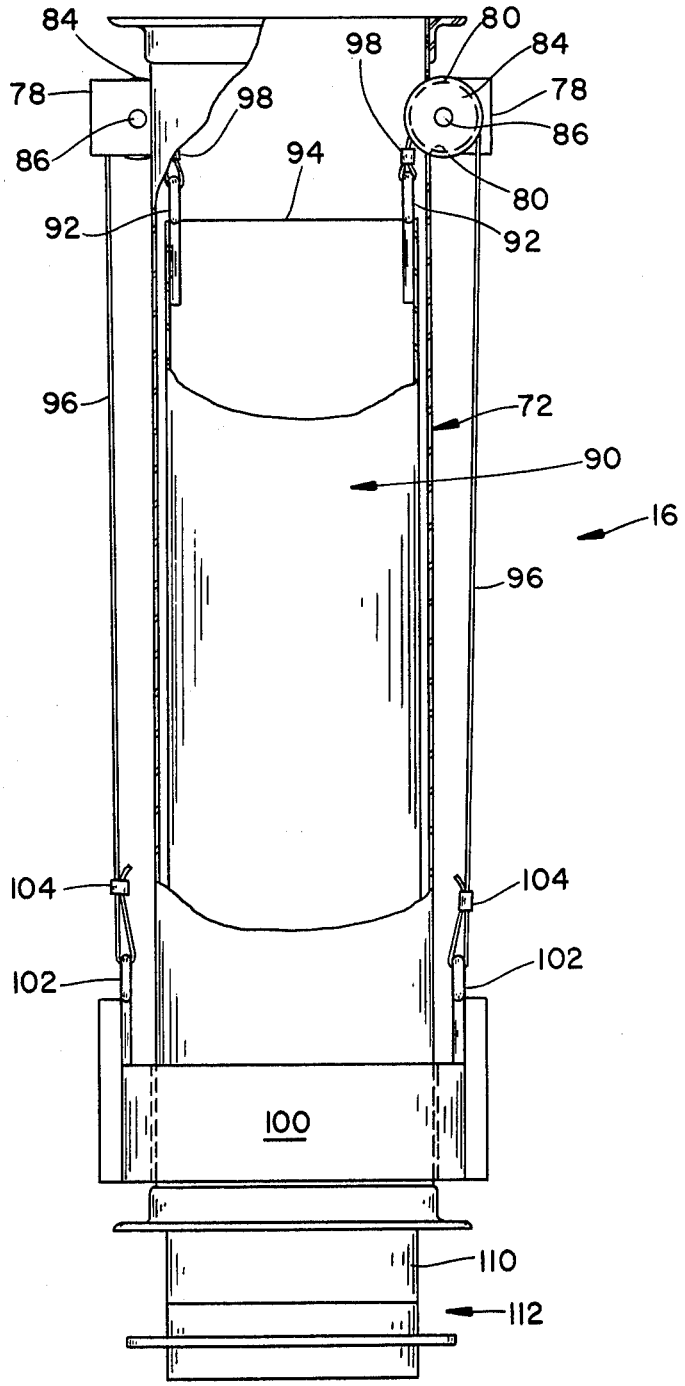
FIG. 5 is a partial sectional side elevational view of a detail of the embodiments of FIGS. 1–4.

A rectangular-to-circular, 90° transition duct section 70 is in open communication with the aforementioned chamber defined within car 48. A vertically extending duct section of conduit 16 is joined at its vertically upper extent to duct section 70. Duct section 70 has a cylindrical cross section, as best illustrated in FIG. 5, and includes a pair of diametrically opposed, axially and radially extending pulley mounts 78. A pair of axially extending openings or slots 80 are provided in the side wall of duct section 72 radially inwardly from pulley mounts 78. A pair of sheaves 84 are journal mounted for rotation upon a pair of shafts 86 supported within pulley mounts 78. Sheaves 84 extend through slots 80 a short distance.

Conduit 16 further includes a vertically lower duct section 90 having a generally cylindrical cross section and an outside diameter slightly smaller than the inside diameter of duct section 72 to be slidable axially therein. A pair of eye bolts 92 are attached internally of the upper lip 94 of duct section 90. Cables 96 are attached using cable clamps 98 to eye bolts 92. The free ends of cables 96 extend through slots 80, over sheaves 84 and downwardly longitudinally along the outside of duct section 72. An annular counterweight 100 having diametrically opposed eye bolts 102 is supported from the free ends of cables 96 by a pair of cable clamps 104. Counterweight 100 is suspended coaxially of duct sections 72, 90 and moves freely adjacent the side wall of duct section 72 to counterbalance the weight of duct section 90. Duct section 90 thereby can be positioned as required by moving it telescopically into or out of duct section 72.

Exhaust hood 12 is attached to the vertically lower end 110 of duct section 90 by a swivel 112 which allows hood 12 to pivot freely axially of section 90 through 360°. Hood 12 in the embodiment of FIGS. 1–2 is directional due to the orientation of its opening 113 such that it exhibits a preference in the direction from which it draws air. Hood 12 is substantially freely movable vertically axially of conduit 16 owing to the telescopic joint explained in connection with FIG. 5. Hood 12 is also substantially freely movable radially of column 18 owing to the mobility of car 48 longitudinally of the main portion 44 of conduit 14. Further, conduit 14 is pivotally supported adjacent its first or proximal end 114. Thus, hood 12 is movable to a variety of locations spaced radially from the axis of column 18 and longitudinally therealong.

Figure 4:
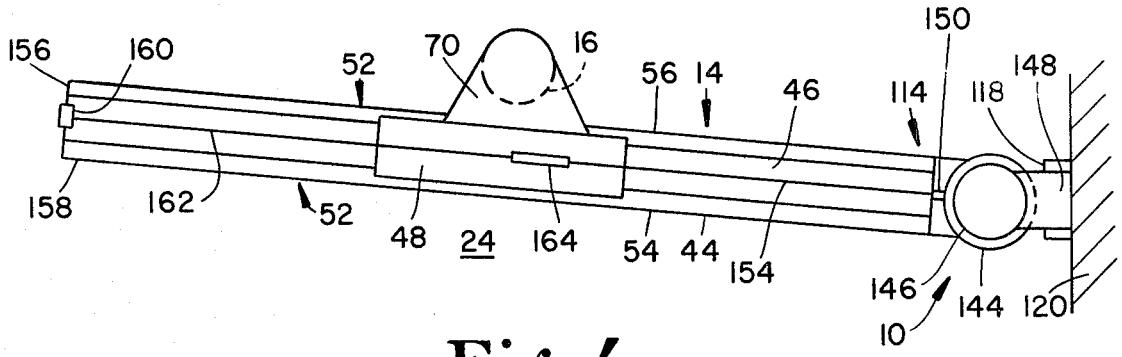
FIG. 4 is a top plan view of the system of FIG. 3.
Figure 3:
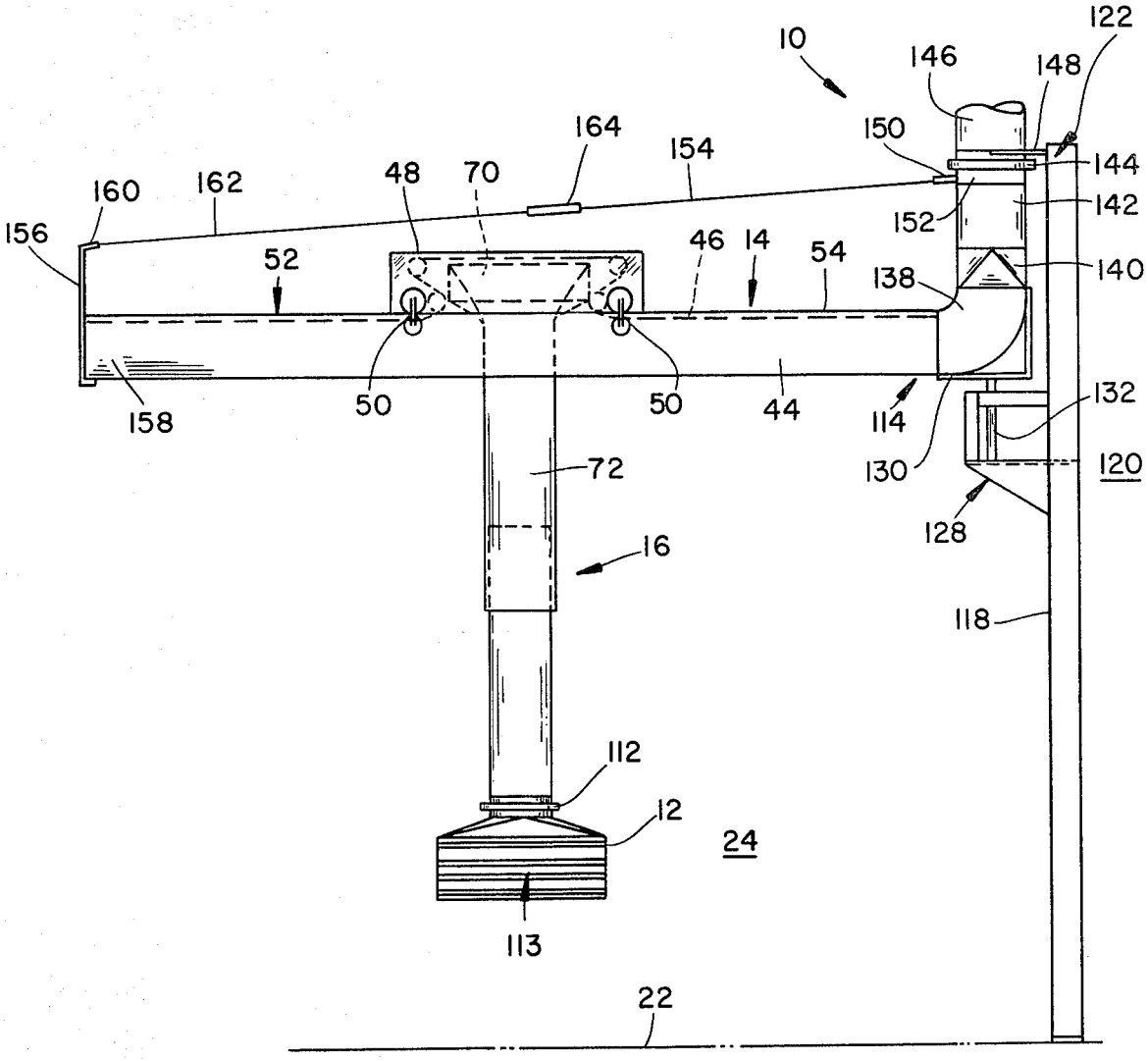
FIG. 3 is a side elevational view of another system constructed in accordance with the present invention.

Referring now to FIGS. 3–4, another embodiment of the instant invention will be described. In the embodiment of FIGS. 3–4, those elements numbered identically with the elements discussed in connection with FIGS. 1–2 and 5 perform the same or similar functions.

In the embodiment of FIGS. 3–4, a support post 118 is attached to the floor 22 of work area 24 and to a wall 120 bounding work area 24. Post 118 extends vertically upwardly to an upper end 122 somewhat above conduit 14. A framework 128 is attached to post 118 intermediate its ends. Framework 128 pivotally supports a pivot member 130 upon a shaft 132. A rising right-angle duct section 138 having a rectangular cross section is supported from pivot member 130.

The proximal end 114 of conduit 14 is attached to the horizontally facing end of duct section 138 in open communication therewith. A rectangular-to-circular transition duct 140 is attached to the vertically upwardly facing end of duct section 138. A duct section 142 extends upwardly from duct section 140 to a swivel 144. Suction means (not shown) are coupled through duct means 146 and swivel 144 to duct section 142. Duct means 146 is attached by a brace 148 to the upper end 122 of support post 118.

Duct section 142 includes an attachment point 150 adjacent its vertically upper end 152. Attachment point 150 receives one end of a supporting cable 154. A bracket 156 is attached to the distal end 158 of conduit 14 and provides an attachment point 160 for a cable 162. The other ends of cables 154, 162 are attached to a turnbuckle 164 by which the tension between the ends 114, 158 of conduit 14 can be adjusted. Cables 154, 162 and turnbuckle 164 thereby assist conduit 14 to support conduit 16 and hood 12.

What is claimed is:

1. An exhaust apparatus comprising a conduit including an elongated duct having proximal and distal ends and a longitudinal wall closed by a flexible web, the conduit further including a car mounted on the duct for movement longitudinally thereof, the car cooperating with the web to define within the car a chamber communicating with the interior of the duct, means for coupling the duct to a source of suction, and means for supporting the duct adjacent its proximal end for pivotal movement in a generally horizontal plane.

2. The apparatus of claim 1 wherein the pivotal support means comprises a vertically extending support member, the duct being pivotally coupled to the support member adjacent its proximal end.

3. The apparatus of claim 2 wherein the means for coupling the duct to a source of suction includes the vertically extending support member, the vertically extending support member having a hollow interior in open communication with the duct.

4. The apparatus of claim 1 and further comprising a second conduit having first and second ends, the first end being coupled to the car in open communication with the car chamber.

5. The apparatus of claim 4 and further comprising an exhaust hood coupled to the second end of the second conduit.

6. The apparatus of claim 4 wherein the second conduit includes means for adjusting the distance between the first and second ends thereof.

7. The apparatus of claim 6 wherein the adjustment means includes a telescoping joint intermediate the first and second ends of the second conduit.

8. The apparatus of claim 7 wherein the adjustment means further includes counterweight means for easing adjustment of the distance between the first and second ends of the second conduit.

9. A multi-position support system for an exhaust hood comprising a generally horizontally extending first conduit, a generally vertically extending second conduit for coupling the hood to the first conduit, means for supporting the first and second conduits and the hood, means for coupling the first conduit to a suction source, the first conduit having first and second ends and being attached to the support means adjacent its first end for pivotal movement about the support means in a generally horizontal plane, the second conduit having a first vertically upper end and a second vertically lower end, means for coupling the first end of the second conduit to the first conduit for movement longitudinally thereof, and means for coupling the second end of the second conduit to the hood, the first conduit comprising an elongated duct having at least one wall closed by a flexible web, said means for coupling the first end of the second conduit to the first conduit including a car mounted for movement longitudinally of the duct, the car cooperating with the web to define within the car a chamber communicating with the interior of the first conduit.

10. The apparatus of claim 9 and further comprising means for adjusting the vertical distance between the first conduit and exhaust hood, the adjustment means including a telescoping joint intermediate the first and second ends of the second conduit.

11. The apparatus of claim 10 wherein the adjustment means further includes counterweight means for easing adjustment of the distance between the hood and the first conduit.

12. The apparatus of claim 9 wherein the second conduit is coupled to the chamber.

13. The apparatus of claim 9 wherein the support means includes a floor-mounted support forming with the first conduit a jib support system for the second conduit and hood.

14. The apparatus of claim 9 and further including suspension cable means connected between the support means and the distal end of the first conduit.

* * * * *